United States Patent [19]

Schaal

[11] 4,085,718

[45] Apr. 25, 1978

[54] EXHAUST GAS RETURN SYSTEM FOR AUTO-IGNITING INTERNAL COMBUSTION ENGINES

[75] Inventor: Christian Schaal, Walddorf, Germany

[73] Assignee: Daimler-Benz Aktiengesellschaft, Germany

[21] Appl. No.: 764,840

[22] Filed: Feb. 2, 1977

[30] Foreign Application Priority Data

Feb. 6, 1976 Germany ..... 2604604

[51] Int. Cl.[2] ..... F02M 25/06

[52] U.S. Cl. ..... 123/119 A; 123/32 R

[58] Field of Search ..... 123/119 A, 32 R

[56] References Cited

U.S. PATENT DOCUMENTS

| | | | |
|---|---|---|---|
| 2,456,213 | 12/1948 | Pelc | 123/119 A |
| 3,135,253 | 6/1964 | Muhlberg | 123/119 A |
| 3,851,632 | 12/1974 | Teshirogi et al. | 123/119 A |
| 3,915,134 | 10/1975 | Young et al. | 123/119 A |
| 3,916,857 | 11/1975 | Naito et al. | 123/119 A |

FOREIGN PATENT DOCUMENTS

| | | | |
|---|---|---|---|
| 1,963,235 | 12/1969 | Germany | 123/119 A |
| 1,964,140 | 12/1969 | Germany | 123/119 A |
| 2,455,777 | 11/1974 | Germany | 123/119 A |

*Primary Examiner*—Wendell E. Burns
*Attorney, Agent, or Firm*—Craig & Antonelli

[57] ABSTRACT

An exhaust gas return installation for auto-ignition internal combustion engines for the admixture of a part of the exhaust gases to the sucked-in air, in which a spring-loaded baffle disk acted upon by the suction air stream together with a valve acted upon by the exhaust counter-pressure control the exhaust gas admixture according to the output and the rotational speed of the internal combustion engine.

31 Claims, 6 Drawing Figures

FIG I
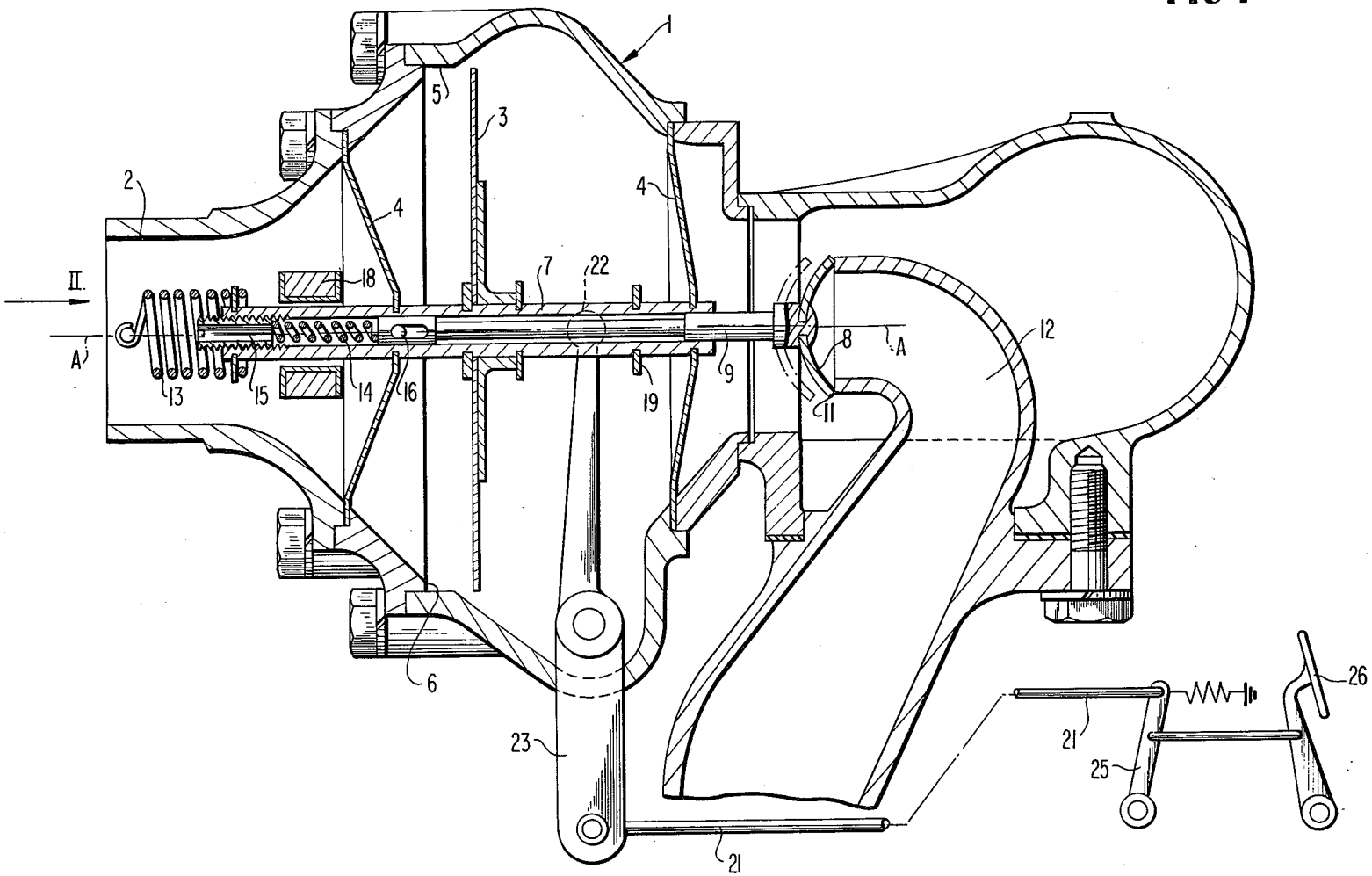

FIG 1a
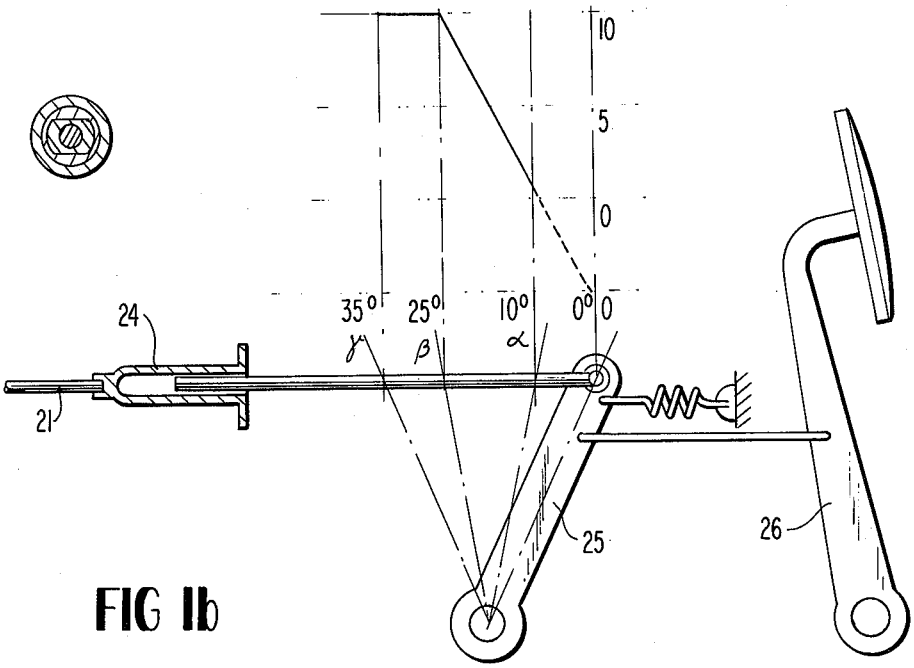
FIG 1b
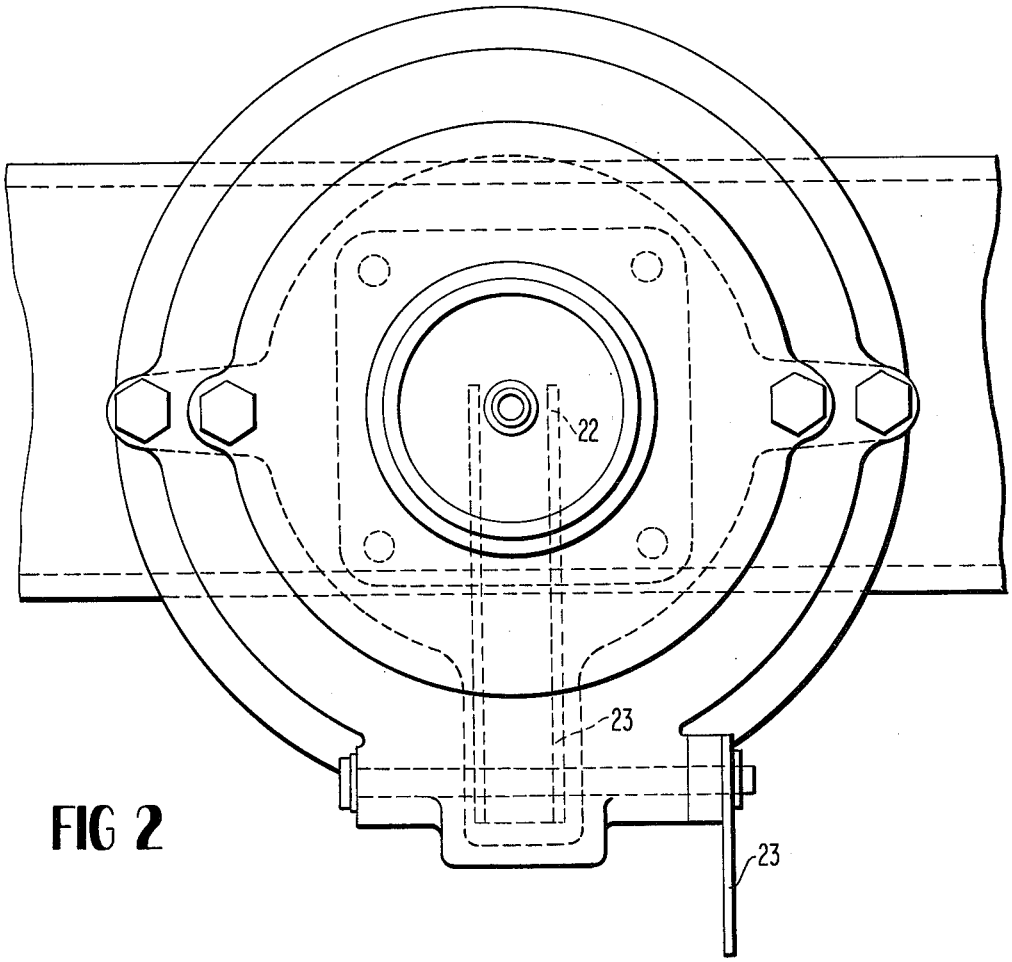
FIG 2

FIG 3
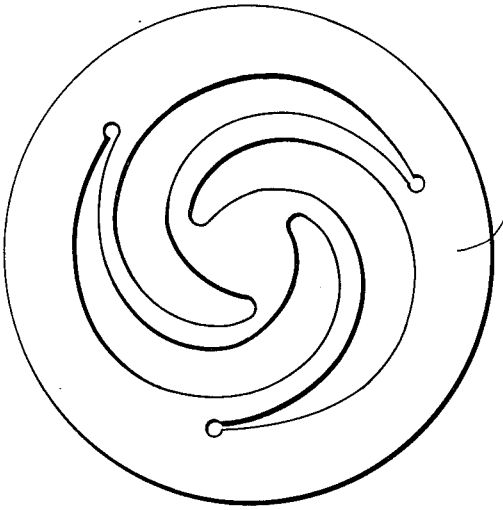
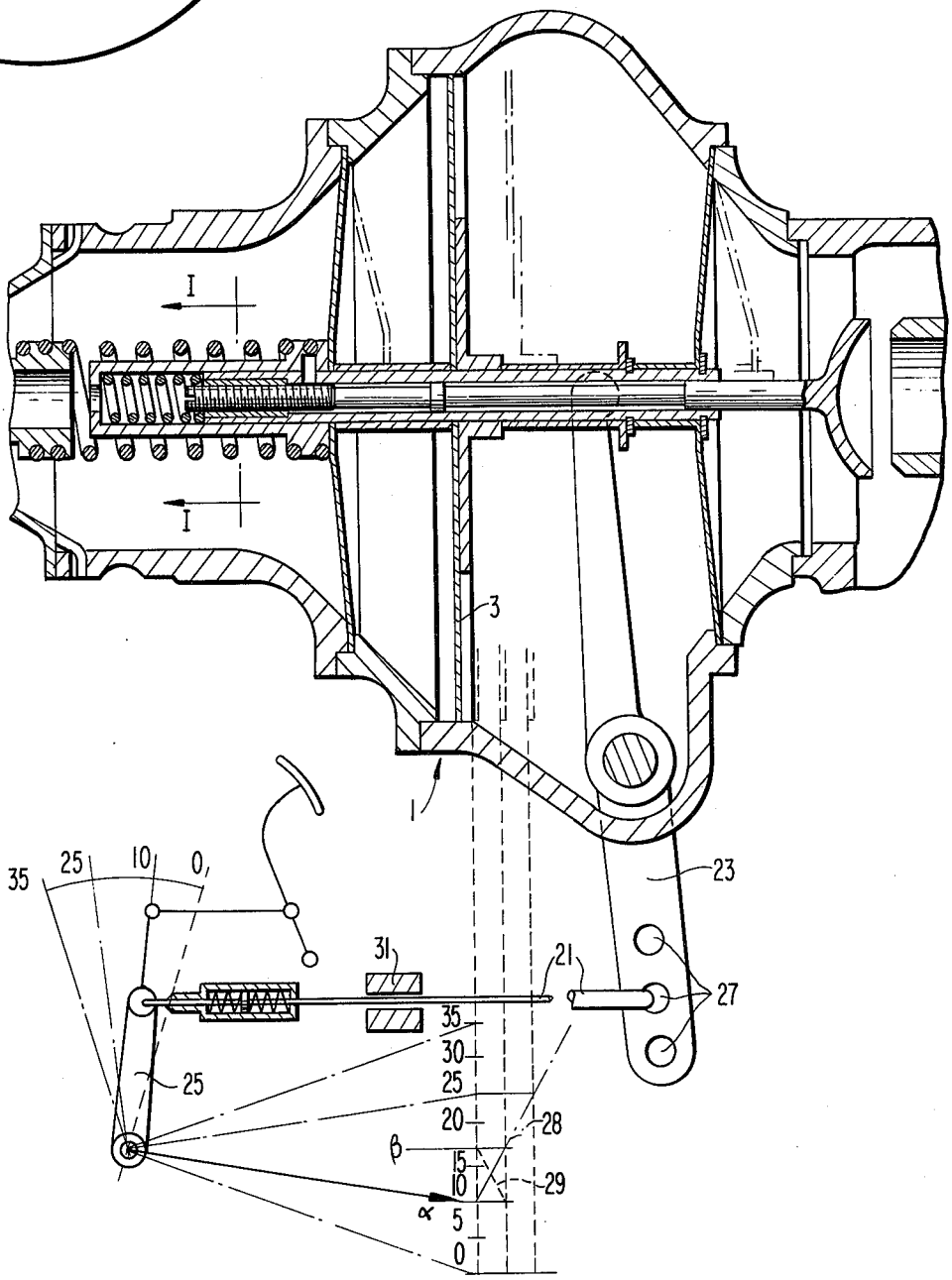
FIG 4

EXHAUST GAS RETURN SYSTEM FOR AUTO-IGNITING INTERNAL COMBUSTION ENGINES

The present invention relates to an exhaust gas return installation for auto-ignition or compression-ignition internal combustion engines for the purpose of admixture of a part of the exhaust gases to the sucked-in fresh air.

In such combustion engines a part of the exhaust gases is conducted back because an improved combustion and therewith an improvement of the composition of the exhaust gases is to be adduced thereby. For that purpose, one has utilized heretofore the most varied types of means; among others, it has already been proposed to measure the temperature of the exhaust gases and to determine therewith the quantity which is branched off from the exhaust gas and conducted back again to the fresh air. These heretofore known processes are expensive to a large extent and doubtful as to their success. Additionally, an optimum matching is not possible with the same in all ranges and under all driving conditions, especially not a far-reachingly automatic adaptation to the different types of situations of the driving conditions.

It is the aim of the present invention to avoid these disadvantages and to realize by simple means an automatic adaptation as well as to propose a constructive solution therefor which automatically undertakes in a simple manner an adaptation of the exhaust gas quantity to be returned within the rotational speed range up to 3,000 r.p.m., i.e., during the cold-start, during idling, during the acceleration and at large driving outputs.

The underlying problems are solved according to the present invention in that a spring-loaded baffle disk acted upon by the suction air stream together with a spherically segmental valve acted upon by the exhaust counterpressure realize the exhaust gas admixture corresponding to the output and the rotational speed of the internal combustion engine.

A baffle disk housing with a baffle disk or baffle plate at least approximately closed during the standstill of the engine may thereby be arranged in the suction pipe adjoining the air filter, which in conjunction with a spherically segmental valve arranged between two springs, whose position is dependent on the exhaust counter-pressure proportional to the engine output, controls the magnitude of the partial quantities of the exhaust gas admixed through an admixture channel in dependence on the rotational speed, whereby the admixture channel terminates at least approximately in the center of the air stream flowing through the baffle disk housing. Furthermore, for the purpose of an output-dependent control, the spherically segmental valve may be controllable additionally from the control lever pivotally connected with the velocity pedal of the engine by way of a spring-mounted drag-linkage. The fresh air sucked in by the engine by way of the baffle disk housing exerts thereby by way of the baffle disk a pressure against a spring pulling the spherically segmental valve directly or indirectly away from the admixture channel orifice, whereby the ratio of the partial quantity of the exhaust gas to the fresh air quantity depends essentially on the spring constant of this spring.

According to a further feature of the present invention, the stem or shaft of the spherically segmental valve may be movable to and fro within predetermined, but adjustable limits inside of a guide pipe movable coaxially to the baffle disk housing axis, in order to open or close more or less the orifice of the admixture channel admixing the exhaust gases which is also arranged coaxially to the spherically segmental valve. The baffle disk may thereby still be movable or displaceable also after the closing of the spherically segmental valve under compression of the compression spring either by an increasing vacuum in the suction pipe or by the actuation at will in the sense of an increase of the through-opening dependent on the baffle disk position.

As to the rest, the guide pipe or tubular member may be held as well as guided concentrically in the baffle disk housing by two spiral spring disks arranged on both sides of the baffle disk and may be pulled off from the orifice of the admixture channel by an adjustable draw-spring disposed in the suction pipe without the flow pressure acting against the baffle disk so far until the baffle disk abuts at an abutment provided in the baffle disk housing. A concentric, springy and elastic suspension of the baffle disk and of the valve is achieved by the spiral spring disks. The suspension is frictionless and also no coking danger results therefrom. Additionally, it is achieved by this suspension that the spherical segment of the valve will adapt itself to the orifice of the admixture channel with small center offsets.

Furthermore, relative movements of the shaft or stem of the spherically segmental valve in the guide pipe are made possible according to the present invention by a compression spring and the latter presses, on the one hand, against the nut of the shaft or stem of the spherically segmental valve disposed on the inside of the guide pipe and, on the other, against an inner collar disposed in the guide pipe. The spherically segmental valve is located at the discharge orifice of the admixture channel. Owing to the constriction of the channel cross section as a result of the existing, built-in structures at this location, the flow velocity of the sucked-in fresh air is increased and a vacuum results therefrom in the gap of the orifice of the admixture channel which enhances the inflow of the exhaust gas out of the admixture channel into the fresh air flowing past this location.

A fork lever is actuated by way of the drag linkage, which mechanically influences the exhaust gas return. The fork lever can be so constructed that it surrounds the guide pipe with its free fork end and during the actuation of the foot pedal beyond a predetermined clearance space abuts at an abutment disk seated on the guide pipe and therewith displaces the guide pipe together with the spherically segmental valve supported in the same toward the orifice of the admixture channel. It is achieved by the spring-mounted drag linkage that the same acts on the spherically segmental valve only after a movement of the control lever from zero to $\alpha$ °. This interaction can then take place for such length of time until after a pivoting of the control lever from $\alpha$ to $\beta$ degrees, the spherical segment is seated on the orifice of the admixture channel. During the starting of the internal combustion engine, no exhaust gases are to be admixed. In order to assure this beforehand, an electromagnet coil may be arranged on the guide pipe which during the starting of the engine is energized and as a result thereof, the spherically segmental valve is held closed thereby.

It is advantageous if the air stream, after the discharge of the exhaust gas stream into the suction pipe, has to traverse only a short distance up to the inlet into the cylinder. On the other hand, it is also to be avoided thereby that stored quantities of an air-exhaust-gas mixture which produce a tidal air effect remain preserved upstream of the inlet valves whereas on the other hand, a uniform mixing of the exhaust gas and of the fresh air is to take place before the mixture reaches the cylinders. For these reasons, it is advantageous if the installation is arranged as close as possible to the bifurcation of the manifold into the individual suction pipes.

Since the exhaust gas channel and therewith also the admixture channel is subjected to large temperature differences and therewith also to large thermal expansions, it may be appropriate that the admixture channel is provided for thermal expansion reasons with a compensating member, before it terminates in the baffle disk housing.

For the purpose of adaptation of the exhaust gas quantity to the rate of air flow and to the control lever position, the point of pivotal connection of the drag lever at the fork lever may be adjustable. A change of the lever ratio is achieved thereby. For that purpose, several bores with the same or different distances from one another may be provided thereby at the fork lever, in which the drag lever is pivotally connected. Additionally, the closing and opening beginning of the exhaust gas valve may be adjusted differently, and a further adaptation can be realized thereby.

Accordingly, it is an object of the present invention to provide an exhaust gas return installation for auto-igniting internal combustion engines which avoids by simple means the aforementioned shortcomings and drawbacks encountered with the prior art.

Another object of the present invention resides in an exhaust gas return installation for internal combustion engines operating with compression-ignition which is relatively inexpensive, yet assures great reliability and effectiveness in its operation for the intended purposes.

A further object of the present invention resides in an exhaust gas return system for compression-ignition internal combustion engines which makes possible an optimum adaptation to the different situations of the driving conditions in all operating ranges and under all driving conditions of the vehicle.

A still further object of the present invention resides in an exhaust gas return system of the type described above which permits an automatic adaptation with simple means over a relatively wide rotational speed range of the engine.

Another object of the present invention resides in an exhaust gas return installation for auto-ignition internal combustion engines which enables an automatic adjustment of the various parts in case of small misalignments due to inaccuracies in the manufacture.

Another object of the present invention resides in an exhaust gas return system which not only prevents the danger of coking of the various parts thereof, especially of the valve, but also assures that the valve is kept closed during the starting of the engine to prevent the admixture of exhaust gases during the cold-starting of the engine.

Still another object of the present invention resides in an exhaust gas return system which permits a uniform mixing of exhaust gas and fresh air before the mixture reaches the cylinder, yet provides simple means for matching the exhaust gas quantity to the rate of air flow and to the control lever position.

Still a further object of the present invention resides in an exhaust gas return system of the type described above which permits different thermal expansions of the various parts thereof without adverse effects on the system and its operation and which additionally provides a wide range of possibilities of adjusting the exhaust gas valve thereof to assure a good adaptation to the desired operating characteristics.

These and further objects, features and advantages of the present invention will become more apparent from the following description when taken in connection with the accompanying drawing which shows, for purposes of illustration only, two embodiments in accordance with the present invention, and wherein:

FIG. 1 is a longitudinal cross-sectional view through the exhaust gas return installation in accordance with the present invention;

FIG. 1*a* is a cross-sectional view taken along line I—I of FIG. 4;

FIG. 1*b* is a diagram, on an enlarged scale, with a function of the exhaust gas curve;

FIG. 2 is a front elevational view on the installation in the direction of the arrow II of FIG. 1;

FIG. 3 is an elevational view of a spiral spring disk provided in the baffle disk housing; and FIG. 4 is a longitudinal cross-sectional view through a modified embodiment of an exhaust gas return installation in accordance with the present invention showing further details which are different from the construction of FIG. 1.

Referring now to the drawing wherein like reference numerals are used throughout the various views to designate like parts, the exhaust gas return installation according to the present invention includes a baffle disk housing generally designated by reference numeral 1 (FIG. 1) with a suction opening 2 through which air is sucked in out of the air filter (not shown). A baffle disk or baffle plate 3 is arranged in the baffle disk housing 1, whose centering and elastic suspension is assured by spiral spring disks 4 (FIGS. 1 and 3) secured in the baffle disk housing 1 which are disposed on both sides of the baffle disk 3. An inner annular surface 5 (FIG. 1) may, as shown in the drawing, be constructed cylindrically. In the illustrated embodiment, it is only slightly larger in its diameter than the outer diameter of the baffle disk 3 so that the baffle disk 3, from its position illustrated in FIG. 1 in dash lines up to its abutment at the shoulder 6, sealingly separates from one another the interior spaces of the baffle disk housing 1 disposed on both sides of the baffle disk 3. This sealing action can be reduced if the inner wall surfaces at the location of the ring-shaped surface 5 are constructed conically so that the baffle disk with an ever-increasing spacing from the abutment surface 6 opens up a continuously increasing gap between the periphery thereof and the inner surface of the baffle disk housing 1.

The baffle disk 3 is seated on a tubular guide member or guide pipe 7 which is movably held and guided by the two spiral spring disks 4 concentrically in the baffle disk housing 1 and in the direction of the axis A—A thereof. The stem or shaft 9 of a spherically segmental valve 8 is able to reciprocate on the inside of the tubular guide member or pipe 7. The spherical segment, properly speaking, is able to seat sealingly on the bevelled off orifice 11 of an admixture channel 12, which is illustrated in FIG. 1. A part of the exhaust gases is supplied to the sucked-in fresh air through the admixture channel 12.

The tubular guide member 7 is being pulled away from the orifice 11 of the admixture channel 12 by a drawspring 13 when no fresh air is sucked in. The spherically segmental valve 8 also follows this movement into the position illustrated in dash and dotted lines in FIG. 1.

The stem or shaft 9 of the spherically segmental valve 8 is guided within the tubular guide member 7 while a compression spring 14 disposed therewith, which, on the one hand, is supported at a hollow screw 15 screwed into the end of the guide pipe 7, presses against the shaft end, on the other hand. As a result thereof, the stem or shaft 9 is displaced so far in the direction toward the orifice 11 of the admixture channel 12 until the pin 16 which is secured in the tubular guide member 7 and is movable to and fro in the slot 17 stops this movement. If the spherical segment 8 of the valve is seated on the orifice 11, then the baffle disk 3 can nonetheless continue to move further in the opening sense because the pin 16 still has play within the slot 17.

The magnet coil 18 arranged about the guide pipe 7 is so constructed that during its energization it brings about a seating of the spherically segmental valve 8 on the orifice 11 of the admixture channel 12. It is made possible thereby that by engaging the magnet coil 18, the spherically segmental valve 8 can be closed without actuation of the accelerating pedal, for example, also when the engine stands still.

An abutment disk 19 is mounted on the tubular guide member 7. The free end 22 of a fork lever 23 presses against the abutment disk 19 during actuation of a drag linkage 21. The drag linkage 21 includes a connecting link 24 (FIG. 1*b*) which is so constructed that during the actuation of a control lever 25 which is pivotally connected at the accelerating pedal 26 of the internal combustion engine, and during the pivoting of the control lever 25 within the area between zero and $\alpha°$, no reaction results on the drag linkage 21 whereas during the pivoting thereof within the range between $\alpha°$ and $\beta°$, the spherically segmental valve 8 is ever more closed until the same seats on the orifice 11 of the admixture channel 12 at $\beta°$ of deflection of the control lever 25. If the control lever 25 is pivoted still further beyond $\beta°$ up to $\gamma°$, then the baffle disk 3 can be further opened by a compressing of the spring 14.

An exhaust gas return installation with a fork lever 23 is illustrated in FIG. 4, whereby several openings 27 are provided in the one end of the fork lever 23 which projects beyond the baffle disk housing 1. The drag lever linkage 21 can be suspended in one of these openings 27. By changing the position of the point of pivotal connection, the ratio of the exhaust gas quantity to the rate of air flow may be changed because the translation ratio of the control lever 25 as regards the position of the fork lever 23 is changed thereby. A further adaptation to changed conditions is possible by the change of the closing or opening beginning of the exhaust gas valve.

FIG. 4 illustrates in two small diagrams in conjunction with the drag lever linkage 21 and the position of the baffle disk 3 how the quantities of air and of exhaust gas conducted through the installation change in dependence on the position of the control lever 25, on the one hand, and of the baffle disk 3 on the other. The line 28 illustrates thereby the air quantity and the line 29 the exhaust gas quantity in the respectively associated positions of the control lever 25 and of the baffle disk 3.

FIG. 4 additionally shows that an electromagnet coil 31 may be arranged also about the drag lever linkage 21 in lieu of being arranged about the guide pipe 7 as shown in FIG. 1.

While I have shown and described only two embodiments in accordance with the present invention, it is understood that the same is not limited thereto, but is susceptible of numerous changes and modifications as known to those skilled in the art, and I therefore do not wish to be limited to the details shown and described herein but intend to cover all such changes and modifications as are encompassed by the scope of the appended claims.

I claim:

1. An exhaust gas return installation for auto-ignition internal combustion engines for admixing a part of the exhaust gases to the sucked-in air, characterized by a control means including a spring-loaded baffle disk means acted upon by the suction air stream and a valve means acted upon by the exhaust counterpressure for controlling the exhaust gas admixture at least approximately corresponding to output and rotational speed of the internal combustion engine.

2. An exhaust gas return installation according to claim 1, characterized in that the valve means is a spherically segmental valve.

3. An exhaust gas return installation with a suction pipe means according to claim 1, characterized in that a baffle disk housing means is arranged in the suction pipe means, said baffle disk housing means including the baffle disk means which is at least approximately closed during standstill of the engine, said baffle disk means controlling in conjunction with the valve means which is arranged between spring means and whose position is dependent on the exhaust counter-pressure proportionally to engine output, the magnitude of the partial quantity of the exhaust gases admixed through an admixture channel means in dependence on the rotational speed.

4. An exhaust gas return installation according to claim 3, characterized in that the admixture channel means terminates at least approximately in the center of the air stream flowing through the baffle disk housing means.

5. An installation according to claim 4, characterized in that the valve means for the output dependent control is additionally controllable by a control lever pivotally connected to an accelerating pedal of the engine by way of a spring-mounted drag linkage means.

6. An installation according to claim 5, characterized in that the valve means includes a valve stem movable to and fro within predetermined limits inside of a guide pipe means in order to more or less open or close the orifice of the admixture channel means admixing the exhaust gases.

7. An installation according to claim 6, characterized in that the guide pipe means is movable substantially coaxially to the baffle disk housing axis, the orifice of the admixture channel means being also arranged substantially coaxially to the valve means.

8. An installation according to claim 7, characterized in that said limits are adjustable.

9. An installation according to claim 7, characterized in that the baffle disk means continues to be movable also after the closing of the valve means under compression of a compression spring either as a result of an increasing vacuum in the suction pipe or by the selective actuation in the sense of an increase of the through opening dependent on the baffle disk position.

10. An installation according to claim 9, characterized in that the valve means is a spherically segmental valve means and in that the orifice of the admixture channel means includes beveled edges as sealing surfaces which are matched to the shape of the sealing surfaces of the spherical segment of the spherically segmental valve means.

11. An installation according to claim 10, characterized in that the guide pipe means is substantially concentrically held and guided in the baffle disk means by two spiral spring disk means arranged on both sides of the baffle disk means and is pulled away from the orifice of the admixture channel means without the flow pressure acting against the baffle disk means by a drawspring secured in the suction opening so far until the baffle disk means abuts at an abutment shoulder provided in the baffle disk housing means.

12. An installation according to claim 11, characterized in that said drawspring is adjustable.

13. An installation according to claim 11, characterized in that a fork lever of the drag linkage means surrounds with its free fork end the guide pipe means and during the actuation of the foot pedal beyond a predetermined clearance space abuts at an abutment disk seated on the guide pipe means and therewith displaces the guide pipe means together with the valve means supported therein toward the orifice of the admixture channel means.

14. An installation according to claim 13, characterized in that an electromagnet coil is arranged about one of the two parts consisting of guide pipe means and drag lever linkage means which is operable to be energized during the starting of the engine and thereby keeps closed the valve means.

15. An installation with an intake manifold according to claim 14, characterized in that the installation is arranged relatively close to the bifurcation of the intake manifold into individual suction pipes.

16. An installation according to claim 15, characterized in that the admixture channel means includes an expansion element for thermal expansion reasons.

17. An installation according to claim 16, characterized in that the point of pivotal connection of the drag lever of the drag linkage means at the fork lever is changeable for the change of the mutual ratio of air quantity and exhaust gas quantity.

18. An installation according to claim 1, characterized in that the valve means for the output dependent control is additionally controllable by a control lever pivotally connected to an accelerating pedal of the engine by way of a spring-mounted drag linkage means.

19. An installation according to claim 1, characterized in that the valve means includes a valve stem movable to and fro within predetermined limits inside of a guide pipe means in order to more or less open or close the orifice of the admixture channel means admixing the exhaust gases.

20. An installation with an admixture channel means according to claim 19, characterized in that the guide pin means is movable substantially coaxially to the baffle disk housing axis, the orifice of the admixture channel means being also arranged substantially coaxially to the valve means.

21. An installation according to claim 19, characterized in that said limits are adjustable.

22. An installation according to claim 1, characterized in that the baffle disk means continues to be movable also after the closing of the valve means uner compression of a compression spring either as a result of an increasing vacuum in the suction pipe or by the selective actuation in the sense of an increase of the through-opening dependent on the baffle disk position.

23. An installation according to claim 3, characterized in that the valve means is a spherically segmental valve means and in that the orifice of the admixture channel means includes beveled edges as sealing surfaces which are matched to the shape of the sealing surfaces of the spherical segment of the spherically segmental valve means.

24. An installation according to claim 19, characterized in that the guide pipe means is substantially concentrically held and guided in the baffle disk means by two spiral spring disk means arranged on both sides of the baffle disk means and is pulled away from the orifice of the admixture channel means without the flow pressure acting against the baffle disk means by a drawspring secured in the suction opening so far until the baffle disk means abuts at an abutment shoulder provided in the baffle disk housing means.

25. An installation according to claim 24, characterized in that said drawspring is adjustable.

26. An installation according to claim 3, characterized in that the valve means includes a valve stem movable to and fro within predetermined limits inside of a guide pipe means in order to more or less open or close the orifice of the admixture channel means admixing the exhaust gases.

27. An installation according to claim 26, characterized in that a fork lever of the drag linkage means surrounds with its free fork end the guide pipe means and during the actuation of the foot pedal beyond a predetermined clearance space abuts at an abutment disk seated on the guide pipe means and therewith displaces the guide pipe means together with the valve means supported therein toward the orifice of the admixture channel means.

28. An installation according to claim 26, characterized in that an electromagnet coil is arranged about one of the two parts consisting of guide pipe means and drag lever linkage means which is operable to be energized during the starting of the engine and thereby keeps closed the valve means.

29. An installation with an intake manifold according to claim 1, characterized in that the installation is arranged relatively close to the bifurcation of the intake manifold into individual suction pipes.

30. An installation according to claim 3, characterized in that the admixture channel means includes an expansion element for thermal expansion reasons.

31. An installation according to claim 18, characterized in that the point of pivotal connection of the drag lever of the drag linkage means at the fork lever is changeable for the change of the mutual ratio of air quantity and exhaust gas quantity.

* * * * *